United States Patent [19]

Kanno et al.

[11] Patent Number: 5,059,478

[45] **Date of Patent: * Oct. 22, 1991**

[54] HEAT-SENSITIVE TRANSFER MATERIAL

[75] Inventors: Nobumori Kanno; Neiji Takeda, both of Tokyo, Japan

[73] Assignee: Toyo Ink Manufacturing Co., Ltd., Tokyo, Japan

[ * ] Notice: The portion of the term of this patent subsequent to Jul. 30, 2008 has been disclaimed.

[21] Appl. No.: 360,936

[22] PCT Filed: Jun. 22, 1988

[86] PCT No.: PCT/JP88/00618

§ 371 Date: Mar. 27, 1989

§ 102(e) Date: Mar. 27, 1989

[87] PCT Pub. No.: WO89/00923

PCT Pub. Date: Feb. 9, 1989

[30] Foreign Application Priority Data

Aug. 5, 1987 [JP] Japan ..... 62-119888[U]
Oct. 30, 1987 [JP] Japan ..... 62-273357

[51] Int. Cl.[5] ..... B41M 5/26

[52] U.S. Cl. ..... 428/321.3; 428/195; 428/484; 428/488.1; 428/488.4; 428/500; 428/522; 428/913; 428/914

[58] Field of Search ..... 428/195, 484, 488.1, 428/488.4, 913, 914, 321.3, 500, 522

[56] References Cited

U.S. PATENT DOCUMENTS

| | | | |
|---|---|---|---|
| 4,518,645 | 5/1985 | Moriguchi et al. | 428/212 |
| 4,707,406 | 11/1987 | Inaba et al. | 428/484 |
| 4,774,128 | 9/1988 | Koshizuka et al. | 428/212 |
| 4,865,913 | 9/1989 | Takeuchi et al. | 428/321.3 |

FOREIGN PATENT DOCUMENTS

| | | | |
|---|---|---|---|
| 282080 | 9/1988 | European Pat. Off. | 428/488.4 |
| 59-96992 | 6/1984 | Japan | 428/488.4 |
| 61-295078 | 12/1986 | Japan | 428/488.4 |
| 63-159086 | 7/1988 | Japan | 428/488.4 |
| 63-191676 | 8/1988 | Japan | 428/488.4 |
| 63-296983 | 12/1988 | Japan | 428/488.4 |

*Primary Examiner*—Pamela R. Schwartz
*Attorney, Agent, or Firm*—Wenderoth, Lind & Ponack

[57] ABSTRACT

A heat-sensitive transfer material which comprises forming a heat-melting ink layer (13) on one surface of a substrate film (11) through an adhesive layer (12) and forming a transfer control layer (14) on said heat-melting ink layer. By forming the adhesive layer which firmly bonds the substrate film and heat-melting ink layer, this invention makes it possible to prevent separation in the interface between the substrate film and the heat-melting ink when printing by transfer and to suitably control the amount of ink transferred through the transfer control layer owing to the function maintenance of the transfer control layer.

8 Claims, 1 Drawing Sheet

HEAT-SENSITIVE TRANSFER MATERIAL

FIELD OF THE INVENTION

This invention relates to a heat-sensitive transfer material for multi-use purpose. More specifically, it relates to a heat-sensitive transfer material which shows a low decrease in density and a high sensitivity after multi-uses, maintains high density and is excellent in resolution.

DESCRIPTION OF RELATED ART

In a heat-sensitive transfer material simply comprising a heat-melting ink layer on a substrate film, the ink is entirely transferred to a recording material in one transfer. Therefore, such a transfer material is disadvantageous in economy since it has to be thrown away after only one use. There are therefore many proposals of heatsensitive transfer materials which permit multiple uses by improving the defects of heat-transfer materials of such a conventional type.

For example, Japanese Laid-Open Patent Publication No. 105579/1980 discloses a multi-use heat-sensitive transfer material having, on its substrate film, an ink layer of porous net-like structure in which a heat-melting ink is filled. In this technique, however, the amount of ink filed in the ink layer is limited. Hence, its defect is that repeated transfer causes a rapid decrease in printing density, and the number of transfers in repetition is limited.

Japanese Laid-Open patent Publications Nos. 40293/1985, 1574/1987, 73994/1987 or the like also disclose a heat-sensitive transfer material formed by laminating a heatmelting ink layer and a transfer control layer on a substrate film. The technique of these Publications is to control the amount of an ink transferred in one operation by means of a microporous layer formed on the surface of the material. Thus, the technique has characteristics that the decrease in density by repetition of transfers can be reduced and the multi-transfers can be carried out while maintaining the same printing quality. However, in such heat-sensitive transfer materials, the heat-melting ink layer and the substrate film separate from each other in the interface depending upon transfer conditions, or the heat-sensitive transfer materials are destroyed. That is, there is a problem that the multi-use thereof for transfer is not possible. Especially, this tendency appears markedly in the case of so-called solid pattern printing, i.e., printing by spreading an ink wholly over on the surface or in rectangular areas. The tendency also appears depending upon heat-sensitive transfer devices, and particularly, this problem tends to occur often in the case of using thermal printers of dotted-line type such as printers for computers.

It is an object of this invention to provide a heatsensitive transfer material which exhibits a smaller decrease in density in multi-transfers and permits stable repeated thermal transfers regardless of the method of use.

SUMMARY OF THE INVENTION

This invention provides a heat-sensitive transfer material formed by providing one surface of a substrate film with a heat-melting ink layer through an adhesive layer and providing a transfer control layer onto said heat-melting ink layer. By providing the adhesive layer to firmly bond the substrate film and the heat-melting ink layer, this invention makes it possible to prevent the failure in multi-transfers caused by transfer of the heat-melting ink layer and the transfer control layer at one time due to separation in the interface between the substrate film and the heat-melting ink layer in printing, and this invention also makes it possible to suitably control the amount of ink to be transferred through the transfer control layer. Accordingly, it is made possible to provide a heat-sensitive transfer material which does not cause a decrease in the density of transferred objects even if the heat-sensitive multi-transfers are carried out.

DESCRIPTION OF THE PREFERRED EMBODIMENTS

The present invention will be explained according to the drawings.

Figure 1:
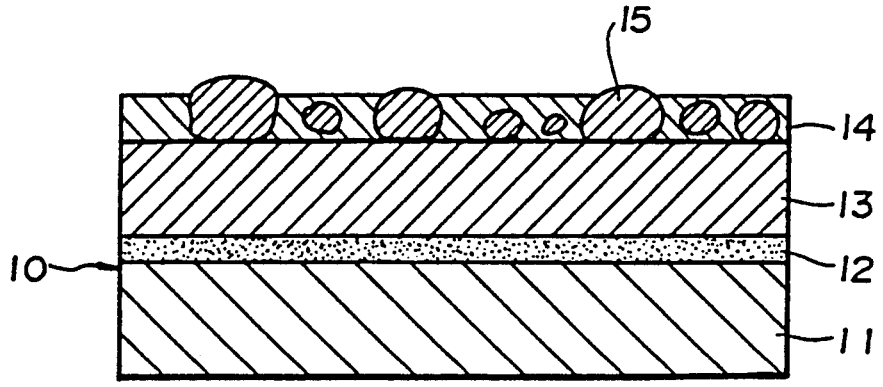
FIGS. 1 to 3 are partially magnified cross-sectional views of the heat-sensitive transfer material of the present invention.
Figure 2:
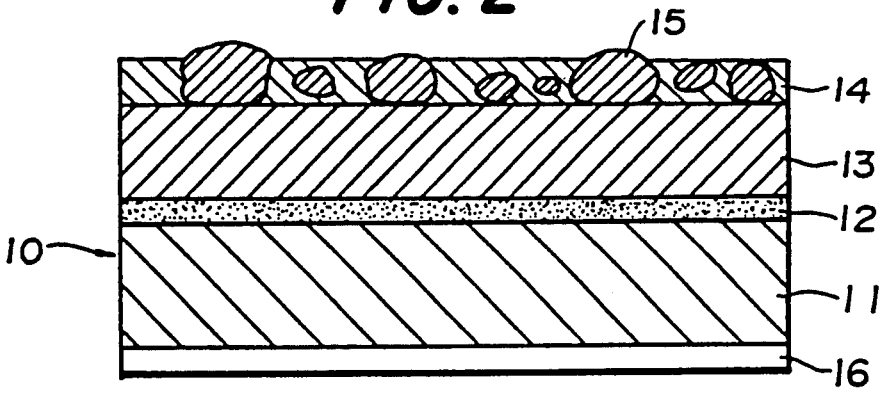
Figure 3:
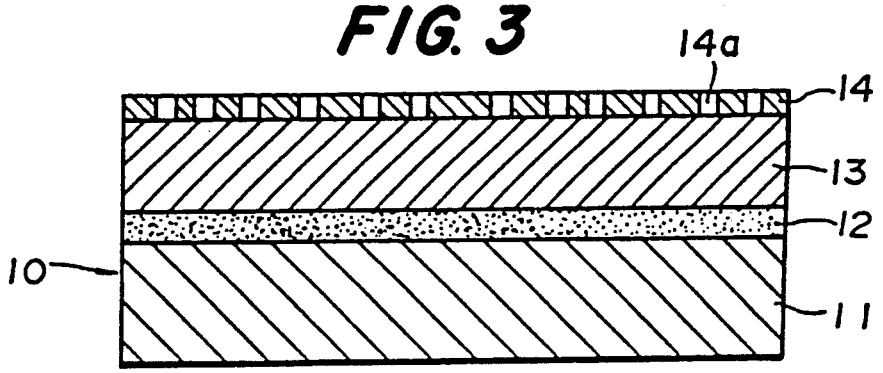

FIGS. 1 to 3 are cross-sectional views of a working example of heat-sensitive transfer material 10 of the present invention, which comprises providing one surface of a substrate film 11 with a heat-melting ink layer 13 through a adhesive layer 12 and providing a transfer control layer 14 onto said heat-melting ink layer. In some cases, a heatresistant layer 16, which is called a backcoat, may be formed on the other surface of the substrate film. The transfer control layer 14 has a surface which is provided with many micropores which reach the ink layer 13. In a more preferable working example, a heat-melting resin (low-melting point resin) or heat-melting ink 15 is filled or held in said pores. The drawings show a state where part of the heat-melting resin or heat-melting ink 15 projects above the surface of the transfer control layer 14. However, in some cases, it is almost embedded.

In this invention, the transfer control layer stands for a layer which permits a molten ink to pass through said pores or pores which are filled with a heat-melting resin or heat-melting ink, and the transfer amount can also be controlled by suitably selecting the diameters of said pores and the number of said pores.

Usable as the substrate film 11 are those which are usually used as a heat-sensitive transfer substrate film, such as plastic films such as polyester films or condenser papers.

Preferably usable as the adhesive layer 12 are high-molecular-weight compounds which have an adhesive ability to both the substrate film and the heat-melting ink at a temperature in the range of from 0° C. to 80° C., preferably from 10° C. to 60° C. Examples of such high-molecular-weight compounds include ethylene-ethylacrylate copolymer, ethylene-vinylacetate copolymer, polyvinyl butyral, polyester resin, polyamide resin, styrene-butadiene copolymer, acryronitrile-butadiene coplymer, raw rubber, acryl resin, polyurethane resin, etc., and they can be used alone or as a mixture of two or more of these. In addition to the above-mentioned thermoplastic resins, crosslinking resins such as thermally crosslinking high polymers or radicaly crosslinking resins may be used, if they have an adhesive ability within the above temperature range.

The adhesive layer 12 has a thickness, preferably, of 0.05 to 5 μm, and may be sufficiently formed on the substrate layer 11 from a solvent solution of one or more of the above high-molecular-weight compounds by using a coating device such as a device for a gravure method.

The heat-melting ink layer 13 is that which is obtained by melting and kneading a pigment or dye such as carbon black, paraffin wax or natural wax, thermoplastic resin such as ethylene-vinyl acetate copolymer, etc., dispersant, and the like. The heat-melting ink layer 13 may be usually applied by hot-melt coating, and in some cases, may also be applied by gravure coating of a dispersion obtained by dispersing the above heat-melting ink composition in a solvent. The thickness of the heat-melting ink layer 13 is preferably 1 μm to 20 μm.

The transfer control layer 14 is that which is obtained by converting an essentially heat-resistant high-molecular-weight compound to a porous one. As an example of such a high-molecular-weight compound, it is possible to cite thermoplastic resin or thermosetting resin such as polyester resin, acrylic resin, polyurethane resin, butyra resin, polyamide resin, cellulose resin or polycarbonate resin. Optionally, instead of using the above resins, the above high-molecular-weight compound may be formed by applying a radiation-curing monomer and then irradiating ultraviolet ray, electron beam, and the like.

It is possible to render the high-molecular-weight compound porous in the transfer control layer by any of known methods, for example:

(1) a method of forming a coating from a solution of a high-molecular-weight compound containing a blowing agent and then permitting the blowing agent to blow by heat treatment.

(2) a method of forming a coating from a solution of a high-molecular-weight compound in which a water-soluble substance is finely dispersed and then removing the water-soluble substance by immersion in water.

(3) a method of adding a relatively high-boiling-point solvent to a solution of a high-molecular-weight compound, forming a coating and then evaporating the high-boiling-point solvent by heat treatment.

(4) a method of forming a coating from a solution of a high-molecular-weight compound in which a low-melting-point substance such as wax or heat-melting ink is finely dispersed, and then drying.

Of the above-cited methods of forming pores, the method (4) is practically preferable in the point that no post treatment is necessary. This method comprises, more specifically, finely dispersing a heat-melting resin or heatmelting ink by adding a solution of 20 to 400 parts by weight, preferably 50 to 200 parts by weight, of a high-molecular-weight compound, which is heat-resistant resin, to 100 parts by weight of the heat-melting resin or heat-melting ink. When the amount of the heat-resistant resin is too large, the density is low at the time of transfer and no sufficient density can be obtained, and when the amount of the heat-resistant resin is too small, the density in transfer in the beginning is too high and the multi-use is not possible. The organic solvent here needs to be selected from those which dissolve the heat-resistant resin but does not dissolve the components of the heat-melting resin or heat-melting ink. The heat-melting resin or heat-melting ink is converted to fine particles by using a dispersing apparatus such as a ball mill, atriter, sand mill, and the like. For example, a solution of the heat-resistant resin and the heat-melting resin or heat-melting ink may be mixed with glass beads or steel beads and stirred to convert same to fine particles. When the heat-melting resin or heat-melting ink is converted to fine particles, additives such as a dispersant, fine powder silica gel, etc., may be added.

Examples of the above solvents which do not dissolve or hardly dissolve the heat-melting resin or heat-melting ink include alcohols such as methyl alcohol, ethyl alcohol, isopropyl alcohol, n-butyl alcohol, etc., ketones such as acetone, methyl ethyl ketone, methyl-n-propyl ketone, etc., esters such as ethyl acetate, isopropyl acetate, n-butyl acetate, etc., and others.

As the resin component in the heat-melting resin or heat-melting ink usable in this invention, it is possible to cite natural waxes such as candelilla wax, carnauba wax, rice wax, have wax, montan wax, etc., petroleum waxes such as paraffin wax, microcrystalline wax, etc., synthetic waxes from coal, polyethylene wax and synthetic waxes from fats and oils such as fatty acid amide, aliphatic ketone, aliphatic amine, fatty acid ester etc., and others.

When the heat-resistant resin is dissolved in a solvent, which does not dissolve or hardly dissolves the heat-melting resin or heat-melting ink, to form a solution of the heat-resistant resin and then the heat-melting resin or heat-melting ink is converted to fine partices and dispersed in the presence of said solution of the heat-resistant resin, if the viscosity of the solution of the heat-resistant resin is too high, it is difficult to convert the heat-melting resin or heat-melting ink into fine particles.

The viscosity of the solution of the heat-resistant resin is, preferably, not more than 2,000 centipoise.

The size of the fine particles of the heat melting resin or heat-melting ink influences on the density and resolution of letters in transfer.

The diameter of the fine particles of the heat-melting resin or heat-melting ink is in the range of, preferably, from 0.01μm to 50μm, and more preferably, of from 0.1μm to 20μm. If said diameter is in the above range, no rapid decrease in the density occurs even in multi-use, and the sufficient resolution of transferred letters can be obtained. If said diameter is smaller than the above range, the resolution of letters is insufficient.

Further, the transfer control layer may be a layer formed from a polymer (particles) of vinyl-type monomer which is a heat-melting resin and a heat-resistant resin which is incompatible with said polymer (particles).

The above polymer, which is usually of particles, is a (co)polymer containing at least one monomer selected from the following vinyl-type monomer group A as essential component and monomer(s) selected from the following vinyl-type monomer group B as optional component.

Vinyl-type monomer group A

The vinyl-type monomer having a long chain alkyl group having not less than 17 carbon atoms is, in general, acrylic ester or methacrylic ester of higher alcohol having not less than 17 carbon atoms, represented by the following general formula $$CH_2{=}\overset{\overset{R_1}{|}}{C}{-}COOR_2$$

wherein $R_1$ is H, $CH_3$, $C_2H_5$, $C_3H_7$, or the like and $R_2$ is a long chain alkyl group having not less than 17 carbon atoms, such as ester of an alcohol such as heptadecyl alcohol, stearyl alcohol, nonadecyl alcohol, eicosy alcohol, heneicosyl alcohol, docosyl alcohol, tricosyl alcohol, tetracosyl alcohol or the like with acrylic acid or methacrylic acid.

Vinyl-type monomer group B

Vinyl-type monomers such as acrylic esters of acrylic acid, methyl acrylate, ethyl acrylate, hexyl acrylate, etc., methacrylic esters of methacrylic acid, ethyl methacrylate, hexyl methacrylate, etc., acrylonitrile, acrylic acid amide, methacrylic acid amide, styrene, vinyl acetate, vinyl esters, styrene, and the like.

The polymer (particles) is obtained by polymerizing the above vinyl-type monomer(s) according to an ordinary method of solution polymerization, suspension polymerization, emulsion polymerization or the like, and preferably, the polymer has a molecular weight of about 1,000 to about 100,000. The polymer (particles) has a melting point in the range, preferably, of from 30 to 150°0 C., and more preferably of from 40 to 120° C.

The polymer (particles) may be an ink which is colored with a coloring agent of which the color is identical with that of the heat-melting ink layer.

The polymer (particles) is dispersed in a solvent, which does not dissolve said polymer (particles), or in water to form a fine dispersion. For this purpose, examples of the solvent used to polymerize the vinyl-type monomer(s) are water or solvents which do not dissolve the polymer (particles) at room temperature such as alcohols and hydrocarbons, and these solvents are used alone or in combination.

The dispersion solution of the polymers (particles) so obtained is mixed with the heat-resistant resin, and the mixture is applied on the heat-melting ink layer formed on the substrate film and then dried to give a transfer control layer which this invention names as such. And the vinyl-type monomer may be polymerized in a solution obtained by predissolving part of whole of the heat-resistant resin in the solvent.

Examples of the heat-resistant resin are those having high glass transition points and selected from acrylic resins, polyamide resins, polyester resins, epoxy resins, polyvinyl butyral, cellulose-type resins, polyvinyl alcohol, etc., and these are used alone or in combination with each other or in combination with a curing agent.

The heat-resistant resin is at least required to be soluble in a solvent used in the dispersion solution of the polymer (particles), and further it is essential that the vinyl-type polymer particles and the heat-resistant resin are not mutually dissolved. That is, in order for the transfer control layer composed of the polymer (particles) and the heat-resistant resin to make it possible to print many times, the polymer (particles) alone has to be melted to flow out and the heat-melting ink has to seep out little by little from the same places by means of head energy when printing. For this reason, it is required that the polymer (particles) and the heat-resistant resin are not mutually dissolved.

The size of the vinyl-type polymer (particles) can be controlled to some extent subject to the amount of an initiator, composition of the solvent and cooling speed.

FIGS. 1 and 2 show the transfer control layer 14 formed by the above method (4), in which the small and large particles 15 of heat-melting resin or heat-melting ink are held in the layer of high-molecular-weight compound which is a heat-resistant resin.

FIG. 3 shows the transfer-control layer formed by the above method (1) or (3), in which many through holes 14*a* are formed in the layer of high-molecular-weight compound which is a heat-resistant resin. The transfer control layer 14 so formed may be further subjected to heat treatment by a heating roll, etc., to fill the through holes 14*a* with ink of the heat-melting ink layer 13.

Further, a heat-sensitive layer having the transfer control layer (containing fine particles of heat-melting resin) obtained by the above method (4) may be heat treated at a temperature not lower than the softening point of the heatmelting resin.

The transfer control layer 14 has a thickness, preferably, of from 0.1μm to 5μm. In addition, the continuous layer of at least porous layer of the transfer control layer 14 is substantially non-transferable.

The heat-sensitive material of this invention has a adhesive layer between the substrate film and the heat-melting ink layer. Therefore, the substrate film and the ink layer are firmly bonded to each other to prevent the separation in the interface between the substrate film and the heat-melting ink. Accordingly, the function of the transfer control layer can be maintained even if the printing is repeated many times. Therefore, the action of suitably adjusting the amount of ink such that he ink is not supplied excessively through the pores of the transfer control layer is maintained and the decrease in density is small even if the transfer is carried out repeatedly.

This invention will be explained hereinbelow according to Examples and Comparative Examples. In Examples, "part" stands for "part by weight".

EXAMPLE 1

Ten parts of Ultrathen UE-760 (ethylene-vinyl acetate copolymer made by Toyo Soda K.K.) was dissolved in 90 parts of toluene to obtain and adhesive (A1).

On the other hand, 20 parts of carbon black, 50 parts of paraffin wax, 20 parts of carnauba wax and 10 parts of an ethylene-vinyl acetate copolymer ware fully kneaded at 90° C. to prepare a heat-melting ink (B1).

Separately, 5 parts of polyester resin (Vylon 200 made by Toyobo K.K.) was dissolved in 25 parts of methyl ethyl ketone. Then, 30 parts of this polyester resin solution and 5 parts of the heat-melting ink (B1) were dispersed in a ball mill together with 30 parts of glass beads to obtain an ink dispersion coating liquid (C1).

Then, the adhesive (A1) was coated on a polyester film having a thickness of 6μm by using a wire bar such that the thickness was 0.5μm, and then the solvent was dried off. The heat-melting ink (B1) was melted at 90° C. and formed on this adhesive layer by a ire bar such that the thickness was 4μm.

Thereafter, the coated material was cooled to room temperature. The ink dispersion coating liquid (C1) was coated on the heat-melting ink (B1) such that the thickness was 1μm, and the solvent was dried off to give a heat-transfer film sample 1.

EXAMPLE 2

Example 1 was repeated except that a styrene-butadiene copolymer (Califlex TR-1101, made by Shell Chemical K.K.) was used in place of ethylene-vinyl acetate copolymer used in Example 1 for the adhesive (A1), to give a heat-transfer film sample 2.

EXAMPLE 3

Example 1 was repeated except that a styrene-butadiene rubber (Solprene T-411, made by Asahi Kasei K.K.)

(adhesive (A3)) was used in place of ethylene-vinyl acetate copolymer used in Example 1 for the adhesive (A1), to give a heat-transfer film sample 3.

EXAMPLE 4

Example 1 was repeated except that an adhesive (adhesive (A4)) obtained by dissolving polyamide resin (Versamid 940 made by Hakusui K.K.), in place of ethylene-vinyl acetate copolymer used in Example 1 for the adhesive (A1), in an isopropyl alcohol/toluene mixed solvent having a mixture ratio of 1:1 was used, to give a heat-transfer film sample 4.

EXAMPLE 5

A heat-melting ink obtained by melting and kneading 20 parts of carbon black, 45 parts of paraffin wax, 30 parts of carnauba wax and 5 parts of an ethylene-vinyl acetate copolymer, in place of the heat-melting ink (B1) of Example 1, was dissolved in a polyester resin solution in the same way as in example 1 to prepare an ink dispersion coating liquid (C2), and the procedures of Example 1 were repeated to give a heattransfer film sample 5.

COMPARATIVE EXAMPLE 1

The heat-melting ink (B1) and ink dispersion coating liquid (C1) of example 1 were directly applied on a polyester film such that the thicknesses were the same as those of Example 1, to prepare a heat-transfer film sample 6.

The heat-transfer films obtained in Examples 1 to 5 and Comparative Example 1 were fixed to a dotted-line-type thermal printer, respectively, and the transfers were carried out in a plural of times by using normal papers (PPC papers) as receptor papers. The results are shown in terms of reflection density, in which larger values show better prints.

TABLE 1

| | Repetition of transfer and density of print | | | | |
|---|---|---|---|---|---|
| | Transfer | | | | |
| | 1st | 2nd | 3rd | 4th | 5th |
| Sample 1 (Ex. 1) | 1.0 | 0.9 | 0.85 | 0.8 | 0.7 |
| Sample 2 (Ex. 2) | 1.0 | 0.9 | 0.85 | 0.8 | 0.75 |
| Sample 3 (Ex. 3) | 1.0 | 0.95 | 0.9 | 0.8 | 0.7 |
| Sample 4 (Ex. 4) | 1.05 | 0.9 | 0.8 | 0.75 | 0.7 |
| Sample 5 (Ex. 5) | 1.0 | 0.9 | 0.85 | 0.8 | 0.7 |
| Sample 6 (CEx. 1) | 1.0 | 0.8 | 0.7 | peeled | peeled |

The results in Table 1 are those obtained by solid printing, i.e., completely covered printing, and when used for printing characters such as figures, etc., even the sample 6 could be used repeatedly more than 5 times as well.

EXAMPLE 6

Vylon 200 (5 parts, polyester resin made by Toyobo K.K.) was dissolved in 25 parts of methyl ethyl keton. 30 parts of this polyester resin solution and 5 parts of carnauba wax were dispersed by a ball mill together with 30 parts of glass beads to obtain a heat-melting resin dispersion coating liquid (C3).

The adhesive (A1) of Example 1 was applied onto a polyester film having a thickness of 6μm such that the thickness was 0.5μm, and then the heat-melting ink (B1) was melted at a temperature of 90° C. and applied thereon by a wire bar such that the thickness was 4μm. The coated material was cooled to room temperature. Then the heat-melting resin dispersion coating liquid (C3) was applied on the heat-melting ink (B1) by a wire bar such that the thickness was 0.5μm, and the solvent was dried off to give a heat-transfer film sample 7.

EXAMPLE 7

Example 6 was repeated by using a heat-melting resin dispersion coating liquid (C4) obtained by using BR-80 (acrylic resin made by Mitsubishi Rayon K.K.) in place of Vylon 200 of Example 6, to give a heat-transfer film sample 8

EXAMPLE 8

Five parts of Celnova BTH 1/2 second (nitro cellulose made by Asahi Kasei K.K.) was dissolved in a mixture solvent containing 15 parts of methyl ethyl ketone and 15 parts of isopropyl alcohol. 35 parts of this solution and 6 parts of rice wax were dispersed by a ball mill together with 30 parts of glass beads to obtain a heat-melting resin dispersion coating liquid (C5).

An adhesive layer was formed on a polyester film having a thickness of 6μm in the same way as in Example 3 by using the adhesive (A3) of Example 3. Further, the heat-melting ink (B1) of Example 1 was melted at 90° C. and applied by a wire bar such that the thickness was 4μm, and, after the coated material was cooled, the heat-melting resin dispersion coating liquid (C5) was applied by a wire bar such that the thickness was 1μm. The solvent was dried off to give a heattransfer film sample 9.

EXAMPLE 9

Example 8 was repeated except that the heat-melting resin dispersion coating liquid (C5) was applied by a wire bar such that the thickness was 2μm, to give a heat-transfer film sample 10.

COMPARATIVE EXAMPLE 2

The heat-melting ink (B1) prepared in Example 1 was coated on a polyester film having a thickness of 6μm at 90° C. by a wire bar such that the thickness was 4μm.

The resultant film is referred to as a heat-transfer film sample 11.

COMPARATIVE EXAMPLE 3

The heat-melting ink (B1) prepared in Example 1 was coated on a polyester film at 90° C. by a wire bar such that the thickness was 4μm. The heat-melting resin dispersion coating liquid (C3) prepared in Example 6 was coated thereon such that the thickness was 0.5μm.

The resultant film is referred to as a heat-transfer film sample 12.

The heat-transfer films obtained in Examples 6 to 9 and Comparative Example 2 and b 3 were fixed to a dotted-linetype thermal printer, respectively, and the transfers were carried out in a plural of times by using normal papers as receptor papers. The results are shown in terms of reflection density, in which larger values show better prints.

TABLE 2

| | Repetition of transfer and density of print | | | | |
|---|---|---|---|---|---|
| | Transfer | | | | |
| | 1st | 2nd | 3rd | 4th | 5th |
| Sample 7 (Ex. 6) | 1.1 | 1.1 | 1.1 | 1.0 | 0.9 |
| Sample 8 (Ex. 7) | 1.2 | 1.1 | 1.1 | 1.0 | 0.9 |
| Sample 9 (Ex. 8) | 1.1 | 1.1 | 1.1 | 1.0 | 0.9 |
| Sample 10 (Ex. 9) | 0.9 | 0.9 | 0.9 | 0.8 | 0.8 |
| Sample 11 (CEx. 2) | 1.5< | 0.1 | — | — | — |

TABLE 2-continued

| Repetition of transfer and density of print | | | | | |
|---|---|---|---|---|---|
| | Transfer | | | | |
| | 1st | 2nd | 3rd | 4th | 5th |
| Sample 12 (CEx. 3) | 1.1 | 0.9 | 0.8 | peeled | peeled |

TABLE 3

| Repetition of transfer and density of print | | | | | |
|---|---|---|---|---|---|
| | Transfer | | | | |
| | 1st | 2nd | 3rd | 4th | 5th |
| Sample 13 (Ex. 10) | 1.0 | 0.9 | 0.9 | 0.8 | 0.7 |
| Sample 14 (Ex. 11) | 1.0 | 0.9 | 0.8 | 0.8 | 0.7 |

EXAMPLE 10

Twenty parts of carbon black, 50 parts of paraffin wax, 20 parts of candelilla wax and 10 parts of an ethylenevinyl acetate copolymer were fully kneaded at 90° C. to prepare a heat-melting ink (B2).

Five parts of Vylon 200 (polyester resin made by Toyobo K.K.) was dissolved in 25 parts of methyl ethyl ketone. This solution and 5 parts of the above heat-melting ink (B2) were kneaded in a ball mill for 1 hour to obtain an ink dispersion coating liquid.

Colonate L (0.5 part, polyisocyanate made by Nippon Polyurethane K.K.) as a curing agent and 0.01 part of stannous octenoate as a catalyst were added to 20 parts of the above ink dispersion coating liquid, and fully mixed to obtain an ink dispersion coating liquid (C6).

The adhesive (A1) of Example 1 was applied on a polyester film having a thickness of 6μm such that the thickness was 1μm, and the solvent was dried off. The heatmelting ink (B2) was melted at 90° C. and applied on this adhesive layer by a wire bar such that the thickness was 4μm. The coated material was then cooled to room temperature, and the ink dispersion coating liquid (C6) was applied on the ink (B2) by a wire bar such that the thickness was 1μm, and the coated material was dried at 50° C. for 1 day.

The resultant film is referred to as a heat-transfer film sample 13.

EXAMPLE 11

Four parts of Aronix M-7100 (acryl resin made by Toa Gosei Chemical K.K.), 1 part of A-TMPT (acryl monomer made by Shin-Nakamura Chemical K.K.), 0.2 part of Dalocure 1173 (sensitizer made by Merck Japan K.K.), 25 parts of methyl ethyl ketone, 6 parts of the heat-melting ink (B1) and 30 parts of glass beads were mixed together and the mixture was shaken in a ball mill for 1 hour. This ink is referred to as an ink dispersion coating liquid (C7).

The adhesive layer of example 2 was applied on a polyester film having a thickness of 6μm such that the thickness was 0.5μ, and the solvent was dried off. The heatmelting ink (B1) was melted at 90° C. and applied on the adhesive layer by a wire bar such that the thickness was 4μm. The coated material was then cooled to room temperature, and the ink dispersion coating liquid (C7) was applied on the heatmelting ink (B1) by a wire bar such that the thickness was 1μm. Then the solvent was dried off at room temperature.

That surface of the resultant sample which was coated with the ink dispersion coating liquid (C7) was subjected to irradiation of an 80 W/cm high pressure mercury lamp located at 15 cm apart at a conveyer speed of 10 m/minute to give a heat-transfer film sample 14. Table 3 shows the results of printings by using the samples 13 and 14. In addition, the heat-transfer film samples were fixed in a serial-type thermal printer and the transfers were carried out in a plural of times by using normal papers as receptor papers.

EXAMPLE 12

Twenty parts by weight of methyl isobutyl ketone, 44.5 parts of isopropyl alcohol and 10 parts of stearyl acrylate were charged into a flask, and while the mixture was stirred in nitrogen atmosphere, the temperature was elevated to 85° C.

Twenty-five parts of methyl isobutyl ketone and 0.5 part of benzoyl peroxide were charged into a dropping tube, and added to the flask over 1 hour. While the temperature was maintained at 85° C., the reaction was continued for 1 hour after the addition was finished.

Then, the reaction liquid was cooled with water while it was rapidly stirred, to give a dispersion. Separately, 3 parts of Celnova BTH 1/2 second (nitrocellulose made by Asahi Kasei K.K.) was dissolved in 40 parts of methyl isobutyl ketone, and 27 parts of the dispersion and 30 parts of isopropyl alcohol were mixed therewith to give a heat-melting resin dispersion coating liquid (C8).

An adhesive layer was formed on a polyester film having a thickness of 6μm in the same way as in Example 1 by using the adhesive (A1), and the heat-melting ink (B1) was melted at 90° C. and applied on this adhesive layer by a wire bar such that the thickness was 5μm. The coated material was then cooled to room temperature, and the heat-melting resin dispersion coating liquid (C8) was applied on the heat-melting ink (B1) by a wire bar such that the thickness was 1μm and the solvent was fully dried off.

The resultant film is referred to as a heat-transfer film sample 15.

EXAMPLE 13

CAB-551 (Cellulose acetate butylate made by Eastman Kodak) was used in place of Celnova BTH 1/2 second used in Example 12, to prepare a heat-melting resin dispersion coating liquid (C9), and the procedures of Example 12 were repeated to give a heat-transfer film sample 16.

EXAMPLE 14

Vylon 200 (polyester resin made by Toyobo K.K.) was used in place of the Celnova BTH 1/2 second used in Example 12. 5 parts of Colonate L (polyisocyanate made by Nippon Polyurethane K.K.) and 0.1 part of stannous octenoate as a catalyst were mixed with 100 parts of Vylon 200 to prepare a heat-melting resin dispersion coating liquid (C10). A sample was prepared in the same way as in Example 12 and left to stand for 1 day.

This sample is referred to as a heat-transfer film sample 17.

EXAMPLE 15

Fifteen parts of Celnova BTH 1/2 second, 25 parts of methyl isobutyl ketone and 10 parts of isopropyl alcohol were charged into a flask, and while the mixture was stirred, the temperature was elevated to 85° C. 15 parts of stearyl acrylate, 0.75 part of 2,2'- azobisisobutyronitrile, 17.25 parts of methyl isobutyl ketone and 17 parts of isopropyl alcohol were charged to a dropping tube and fully mixed. Then, the mixture was added dropwise to the flask over 1 hour. The mixture was further stirred for 1 hour at 85° C., and then cooled with ice water while stirring it rapidly.

Forty parts of isopropyl alcohol and 44 parts of methyl isobutyl ketone were added to 16 parts of the above dispersion and mixed fully therewith to give a heat-melting resin dispersion coating liquid (C11).

The adhesive (A2), the heat-melting ink (B2) and the heat-melting resin dispersion coating liquid (C11) were applied successively on a polyester film having a thickness of 6μm to give a heat-transfer film sample 18.

COMPARATIVE EXAMPLE 4

Example 12 was repeated except that the adhesive layer of Example 12 was not formed, to give a heat-transfer material. This ample is referred to as a heat-transfer film sample 19.

The heat-sensitive transfer materials obtained in Examples 12 to 15 and Comparative Examples 4 were respectively fixed in a dotted-line-type thermal printer, and the transfers were carried out in a plural of times by using normal papers as receptor papers.

The results thereof are shown in reflection density, in which the larger values show better prints.

TABLE 4

| Repetition of transfer and density of print | | | | | |
|---|---|---|---|---|---|
| | Transfer | | | | |
| | 1st | 2nd | 3rd | 4th | 5th |
| Sample 15 (Ex. 12) | 1.2 | 1.1 | 1.0 | 0.9 | 0.9 |
| Sample 16 (Ex. 13) | 1.2 | 1.1 | 1.0 | 0.9 | 0.85 |
| Sample 17 (Ex. 14) | 1.2 | 1.1 | 1.0 | 0.9 | 0.9 |
| Sample 18 (Ex. 15) | 1.1 | 1.0 | 0.9 | 0.9 | 0.9 |
| Sample 19 (CEx. 4) | 1.1 | 1.0 | 0.9 | peeled | peeled |

Industrial Utility

As discussed above, the heat-sensitive transfer material of this invention exhibits a small decrease in density of transferred images when transfer was repeated, and further it is capable of being multi-used stably in transfer by using thermal printers of various types.

We claim:

1. A heat-sensitive transfer material produced by forming an adhesive layer on one surface of a substrate film, forming a heat-melting ink layer on the adhesive layer and forming a transfer control layer on the heat-melting ink layer, the transfer control layer being formed by applying a dispersion solution of a heat-melting resin, a wax or a heat-melting ink in a heat-resistant resin.

2. A heat-sensitive transfer material according to claim 1 wherein the adhesive layer comprises a high-molecular-weight compound which has an adhesive ability both to the substrate film and the heat-melting ink layer at a temperature in the range of from 0° C. to 80° C.

3. A heat-sensitive transfer material according to claim 1 wherein the heat-melting ink of the transfer control layer is identical to the ink of the heat-melting ink layer.

4. A heat-sensitive transfer material according to claim 1 wherein the heat-melting ink of the transfer control layer differs from the ink of the heat-melting ink layer.

5. A heat-sensitive transfer material according to claim 1 wherein the heat-resistant resin is a thermosetting resin or radiation-curing resin.

6. A heat-sensitive transfer material according to claim 1 wherein a heat-resistant layer is formed on the other surface of the substrate film.

7. A heat-sensitive transfer material according to claim 1, wherein the heat-melting resin is a polymer obtained from at least one compound of the formula (1)

$$CH_2{=}\overset{\overset{R_1}{|}}{C}{-}COOR_2$$

wherein $R_1$ is a hydrogen atom or an alkyl group having 1 to 3 carbon atoms, and $R_2$ is a long-chain alkyl group having at least 17 carbon atoms;

and optionally at least one compound selected from the group consisting of formula (2)

$$CH_2{=}\overset{\overset{R_3}{|}}{C}{-}COOR_4$$

wherein $R_3$ is a hydrogen atom or a methyl group, and $R_4$ is an alkyl group having up to 6 carbon atoms, and formula (3)

$$CH_2{=}\underset{\underset{R_5}{|}}{CH}$$

wherein $R_5$ is a cyano, phenyl, aminocarbonyl or acetoxy group.

8. A heat-sensitive transfer material according to claim 7 wherein the heat-melting resin is a polymer obtained by suspension polymerization.

* * * * *

UNITED STATES PATENT AND TRADEMARK OFFICE

CERTIFICATE OF CORRECTION

PATENT NO. : 5,059,478

DATED : October 22, 1991

INVENTOR(S) : Nobumori KANNO et al.

It is certified that error appears in the above-identified patent and that said Letters Patent is hereby corrected as shown below:

Col. 12,

Claim 7, line 7 (counting the formula as one line), "at" should read -- not --.

Signed and Sealed this

Twenty-sixth Day of October, 1993

*Attest:*

Bruce Lehman

BRUCE LEHMAN

*Attesting Officer*

*Commissioner of Patents and Trademarks*